United States Patent [19]

Kelley

[11] 4,401,283

[45] Aug. 30, 1983

[54] YARN TUBE

[76] Inventor: Douglas M. Kelley, P.O. Box 1131, Greenwood, S.C. 29646

[21] Appl. No.: 323,472

[22] Filed: Nov. 20, 1981

Related U.S. Application Data

[63] Continuation-in-part of Ser. No. 206,156, Nov. 12, 1980, abandoned.

[51] Int. Cl.[3] ..... B65H 75/10

[52] U.S. Cl. ..... 242/118.32

[58] Field of Search ..... 242/118.32, 118.3, 118.31, 242/46.2, 46.21, 46.4; 428/35, 36

[56] References Cited

U.S. PATENT DOCUMENTS

| | | | |
|---|---|---|---|
| 2,945,638 | 7/1960 | Crawford et al. | 242/118.32 |
| 3,002,872 | 10/1961 | Dunlap, Sr. et al. | 242/118.32 X |
| 3,167,263 | 1/1965 | Lamb et al. | 242/46.21 |
| 3,643,888 | 2/1972 | Blue | 242/118.32 |
| 3,746,275 | 7/1973 | Whisnant | 242/118.32 |
| 3,871,601 | 3/1975 | Crawford et al. | 242/118.32 |

FOREIGN PATENT DOCUMENTS

| | | | |
|---|---|---|---|
| 2039517 | 2/1972 | Fed. Rep. of Germany | 242/118.32 |

*Primary Examiner*—Stanley N. Gilreath
*Attorney, Agent, or Firm*—Ralph Bailey

[57] ABSTRACT

An improved reuseable yarn tube is illustrated for use in winding yarn such as polypropylene yarn which has at least some degree of elasticity so as to exert a formidable crushing force upon the tube when wound into a package. The yarn tube is illustrated as being manufactured of an injection molded thermoplastic polymer having glass fiber and a compatible coupling agent.

3 Claims, 3 Drawing Figures

YARN TUBE

This is a continuation-in-part of pending application Ser. No. 206,156 filed Nov. 12, 1980, entitled YARN TUBE, now abandoned.

BACKGROUND OF THE INVENTION

Yarn tubes have long been provided for use on winders and such have usually been of paper. Such yarn tubes are of standard lengths from of 6½ inches, 8½ inches and 13 inches having an approximate inside diameter of 3¼ inches. It has been found in connection with use on winders such as a Leesona 959 winder that such tubes possess substantial disadvantages in that there is not sufficient crushing strength of the tube to accommodate large packages of polypropylene slit type yarn and the like because such will crush or distort inwardly so as to prevent regular doffing of the package from the spindle of the winder. Such spindles are often constructed having circumferentially spaced ribs so that the dimensional stability of the tube carrying many convolutions of yarn thereon is of the utmost importance.

Prior to this invention phenolic or aluminum tubes have largely replaced the paper tubes in an attempt to eliminate these problems. Aluminum tubes bend if dropped and will not fit properly on winders. Phenolic tubes will not bend or break, but after yarn is cut off a number of times, these tubes will surface flake and end-chip off, and such cannot be recycled.

The manufacture of yarn carrier structures (bobbins, etc.) for winding various synthetic yarns is thus will known in the art and covers a range of manufacturing techniques, i.e. metal forming, hand lay up techniques, etc., which utilize an array of materials. Materials include aluminum, phenolics, various impregnated papers and cloth, and a range of thermoplastics. The nature of the yarn and winding process dictates the engineering qualities that a tube must possess, i.e. strength, rigidity, creep resistance, surface smoothness, temperature resistance, crush resistance, abuse (impact) resistance, etc., if the tube is to be successfully repeatably used as a textile yarn carrier structure.

Heretofore, the use of precision injection molded thermoplastic tubes or bobbins for repeated winding of yarns that have elastic properties and memory which result in imposing very severe time dependent compressive stresses on a bobbin as they are wound into a package has not been achieved. This problem is described in U.S. Pat. No. 3,002,872. Reference is also made to U.S. Pat. No. 3,167,263. Yarns which are capable of exerting severe winding tensions, i.e. 0.1 to 0.2 grms per denier are described in the industry as flat tape, monofilament, fibrillated and twisted yarns, respectively. These yarns are primarily manufactured from synthetic polypropylenes and polyamides (nylons) which require, due to the nature of the yarn, high winding tension to provide a useable tight self-contained package. The high winding tension results in an immediate compressive stress on the bobbin at the initiation of winding while at the same time it elastically stretches the yarn. During and subsequent to winding, the elastically stretched yarn attempts to recover its original relaxed state and this "yarn memory" imposes a time dependent compressive stress on the bobbin.

The use of injection molded foamed reinforced thermoplastic bobbins as suggested in West German Pat. No. 2,039,517 of 1972 as disposable bobbins for synthetic yarn winding, would not be suitable for repeated winding due to the extent of deformation occurring during the first winding and yarn relaxation process. Table 1 below lists engineering properties for one of the materials referred to in the West German patent against similar properties for materials used and included herein. The difference in rigidity, strength and creep rupture failure times of the two materials substantiates and supports the contention that bobbins which will see repeated use must be manufactured from specially selected and designed engineering materials.

The object of this invention is to provide a means by which the economical process of injection molding may be utilized to manufacture reuseable cost effective high tension bearing textile yarn carrier structures. It was found by experimentation that chemically coupled glass fiber reinforced thermoplastics, as sometimes used such as in pressure pipes, gears, and pump components had the necessary short term and long term engineering properties to be economically viable for the present structures. Dimensions of the tube were selected to be compatible with the material choice so that a utilitarian tube would result.

Accordingly, it is an important object of the present invention to provide an economical yarn tube having substantial strength to resist crushing.

Another important object of the invention is to provide tubes which are inexpensive and which may be recycled and possess strength against abrasion and misuse.

Such tubes are used for packaging yarn for positioning upon a creel to make beams. These tubes are also used for filling yarn on shuttleless looms. The most important use for the yarn tube of the present invention which is now envisioned is for use in winding slit yarn for use in carpet backing.

The prior art is typified by U.S. Pat. Nos. 2,945,638; 3,002,872; 3,643,888; 3,746,275; and 3,871,601. These patents show tubes of various constructions but none show the combination of particular dimension and material which has been provided to afford a recyclable yarn tube capable of withstanding substantial yarn crushing forces.

SUMMARY OF THE INVENTION

It has been found that a yarn tube having superior crush strength may be economically manufactured by injection molding polypropylene having from about 5% to about 40% fiberglass reinforcing with a wall thickness of about ¼ inch for reception upon the spindle of a winder such as the Leesona 959 winder and the like. It has further been found, however, in order to economically produce tubes of superficial strength to permit reuse, that coupling agents compatible with a suitable thermoplastic polymer must be nonfoaming and injection molded.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
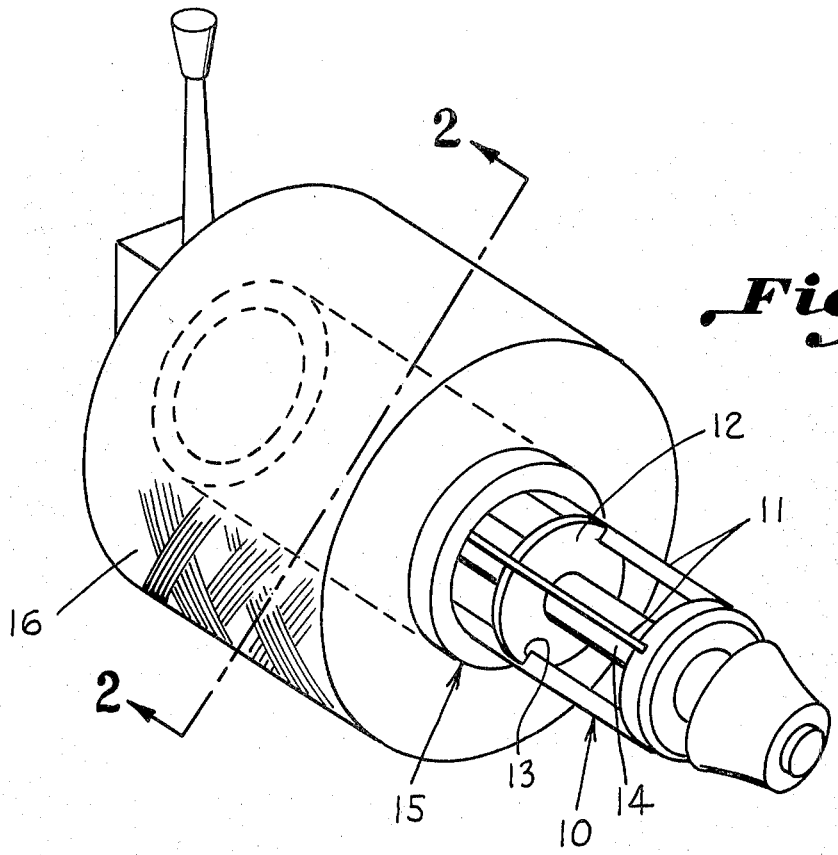
FIG. 1 is a perspective view illustrating a tube constructed in accordance with the present invention carried upon a spindle of a winder in the process of winding a yarn package.

The drawing illustrates a reuseable yarn tube for winding polypropylene yarn and the like upon spindles without crushing or excessive inward deformation of the tube as would obstruct doffing. A molded elongated cylindrical tube has a wall thickness of from about 0.2 inches to about 0.3 inches and an inside diameter of approximately 3¼ inches. The tube is formed by injection molding of a nonfoamed composition including a thermoplastic polymer having a glass content of from about 5–45% and a compatible coupling agent affording compressive strength on the order of about 9500 p.s.i. at 23° C. Thus, the yarn tube may be received upon spindles having spaced ribs and the like after repeated usage.

A preferred composition, which is also injection molded, might include, for example, 40% glass fiber with 20% coupling agent (coupling agent would consist of polypropylene functional copolymers including, polypropylene acrylic acid copolymer or equivalent polypropylene carboxylic acid or anhydride precursor, copolymer type) and 40% polypropylene homopolymer.

Another preferred injection molded composition would be 60% styrene acrylonitrile, a fibrous reinforcement having glass fiber treated with 0.1–1% of a silane adhesion promotor (chemical coupling agent), and 10% fibrous mineral.

The following U.S. patents relate to the use of compatible polypropylene copolymers adhesion promotor for glass fiber encapsulate in polypropylene and other similar thermoplastic compositions: Nos. 3,862,265; 4,001,172 and 4,000,111.

The following U.S. patents relate to the use of compatible fiber coatings to promote glass fiber adhesion to styrenic polymers: Nos. 2,544,667; 2,544,668; 2,688,006; 2,688,007; 2,841,566 and 2,742,378.

A comparison of the properties of the present tubes with those of the prior art is set forth below:

TABLE 1

| | 30% Glass Fiber Reinforced Poly-Propylene of West German Patent | 30% Glass Fiber Specially Coupled Polypropylene Hereof |
|---|---|---|
| Tensile Strength (psi) @23° C. | 7500 | 12500 |
| Flexural Strength (psi) @23° C. | 11000 | 18200 |
| Compressive Strength (psi) @23° C. | 7400 | 9500 |
| Tensile Modulus (psi) @23° C. | 720,000 | 800,000 |
| Tensile Strength (psi) @80° C. | 2900 | 7000 |
| Tensile Modulus (psi) @80° C. | 310,000 | 540,000 |
| Notched Izod Impact (ft. lbs/in) @23° C. | 1.2 | 2.0 |
| Creep Rupture Times | | |

TABLE 1-continued

| | 30% Glass Fiber Reinforced Poly-Propylene of West German Patent | 30% Glass Fiber Specially Coupled Polypropylene Hereof |
|---|---|---|
| (hrs) @23° C. | | |
| Stress = 4000 psi | 500 | 1 yr. |
| = 6000 psi | 5 | 1 yr. |

Depending on the type of yarn and dimensions of the tube, the compressive stress exerted upon the tube may be considerably higher than 6000 p.s.i.

Figure 2:
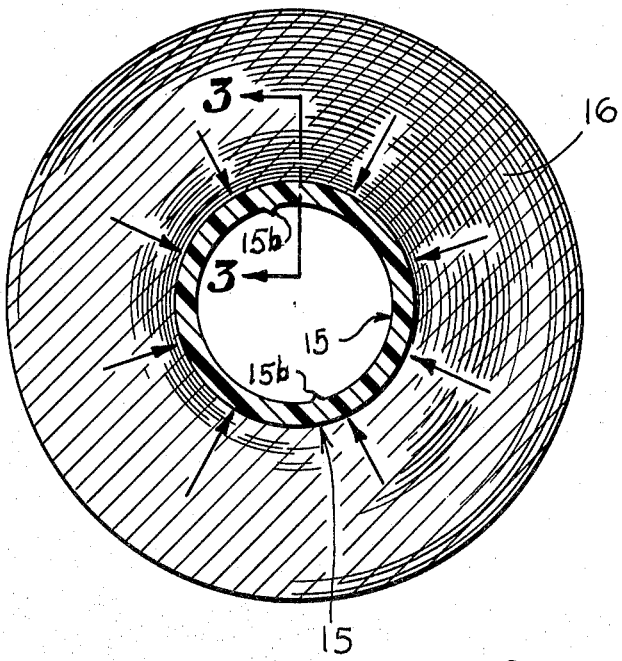
FIG. 2 is a transverse sectional elevation taken on the line 2—2 in FIG. 1.
Figure 3:
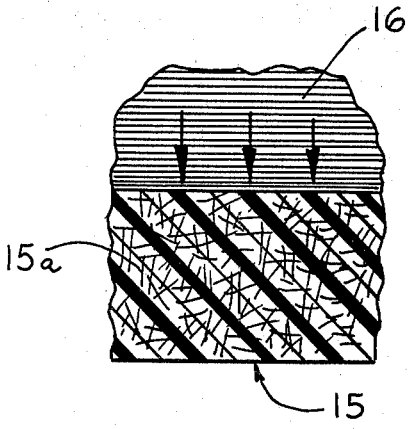
FIG. 3 is an enlarged sectional elevation taken on the line 3—3 in FIG. 2 illustrating the internal construction of the tube.

FIG. 1 illustrates a spindle of a Leesona 959 winder broadly designated at 10. The spindle includes a plurality of circumferentially spaced expansible and retractable ribs 11 which have transverse, longitudinally spaced cylindrical supports 12 which carry the ribs within circumferentially spaced slots 13. The spindle has an axial longitudinally disposed spindle shaft or blade. A tube constructed in accordance with the present invention is illustrated as being carried thereon and is designated broadly at 15. The tube 15 is illustrated as carrying slit tape polypropylene yarn in a package or cheese 16. The tube 15 is illustrated in FIG. 3 as having glass fibers **15*a* randomly dispersed therein to reinforce the polypropylene of which the yarn tube hereof is molded. It will be noted from the inwardly directed arrows in FIG. 2 that the yarn exerts an enormous crushing force upon the tube after it is wound and sometimes such is sufficient to distort the tube inwardly to prevent the tube from being doffed in the usual fashion. It is also important to note that the tube has circumferentially spaced longitudinal ribs to lock the tube against rotation on the spindle and at least one such rib or stop 15*b*** should be provided.

It has been found important in the present invention to manufacture the tube, having a substantially smooth surface, as on a conventional screw injection molding machine. The material from which the tube is constructed is very important in that polypropylene having a percentage of glass fibers and coupling agent as described above has been found to be preferred. It is believed that if less than 5% of fiberglass is used, the tube will not have sufficient strength to withstand the crushing force of the yarn and that over about 45% will result in the tube being too brittle. Moreover, if less than 5% fiberglass is used, a tube having an excessive wall thickness would be necessitated to offer sufficient resistance to crushing. A wall thickness of about 0.2 to about 0.3 inches has been found to be satisfactory. The tube is of uniform inner and outer diameter and is especially adapted to be used on spindles having a diameter of approximately 3 inches so as to accommodate a tube having approximately that same internal diameter.

It is thus seen that an improved yarn tube is provided which may be economically constructed and which is recyclable as it is necessary simply to chop up the worn tubes and add a certain percentage of virgin material and injection mold new tubes therefrom. Not only would recycling be impossible with foamed thermoplastic but substantial foaming would so impair the compressive strength and other required properties that repeated use of such tube would be impractical. It is the use of the thermoplastic polymer with glass reinforcing and coupling agent with the compatible dimensions that make such reuseable tube possible.

While a preferred embodiment of the invention has been described using specific terms, such description is for illustrative purposes only, and it is to be understood that changes and variations may be made without departing from the spirit or scope of the following claims.

What is claimed is:

1. A reuseable and as necessitated recycleable yarn tube for winding polypropylene yarn and the like upon spindles without crushing or excessive inward deformation of the tube as would obstruct doffing comprising:

a molded elongated cylindrical tube having a wall thickness of from about 0.2 inches to about 0.3 inches and an inside diameter of at least approximately 3¼ inches;

said tube being formed by injection molding of a nonfoamed composition including a thermoplastic polymer having a fibrous reinforcement content of from about 5–45% and a compatible coupling agent affording compressive strength at least on the order of about 9500 psi at 23° C.;

whereby said yarn tube may be received upon spindles having spaced ribs and the like after repeated usage.

2. The structure set forth in claim 1 wherein said thermoplastic polymer is polypropylene and said coupling agent is about 20% polypropylene carboxylic functional copolymer.

3. The structure set forth in claim 1 wherein said thermoplastic polymer is a styrenic polymer and the fibrous reinforcement content is about 40% of which about 75% is a glass treated with about 0.1 to 1% of a silane adhesive promoter and about 25% is a fibrous mineral.

* * * * *